United States Patent [19]

Koppensteiner et al.

[11] 4,186,482

[45] Feb. 5, 1980

[54] TOOL AND METHOD FOR INSTALLING FLEXIBLE TUBING IN A MULTI-CAPSULE REED RELAY SWITCHING ASSEMBLY

[75] Inventors: James V. Koppensteiner, Chicago; Khaja M. Jameel, Glen Ellyn; Charles K. Kubik, Brookfield; George Len, Arlington Heights, all of Ill.

[73] Assignee: GTE Automatic Electric Laboratories Incorporated, Northlake, Ill.

[21] Appl. No.: 947,978

[22] Filed: Oct. 2, 1978

[51] Int. Cl.[2] ..... H01H 11/00

[52] U.S. Cl. ..... 29/622; 29/235; 29/280; 29/758; 200/301

[58] Field of Search ..... 29/758, 235, 280, 282, 29/729, 278, 622; 200/301, 288, 217; 235/152

[56] References Cited

U.S. PATENT DOCUMENTS

| | | | |
|---|---|---|---|
| 3,119,174 | 1/1964 | Wokeck | 29/235 |
| 3,128,356 | 4/1964 | Lychyk | 335/152 |
| 3,237,096 | 2/1966 | Zechman | 335/152 |
| 3,909,936 | 10/1975 | Ray | 29/758 |

*Primary Examiner*—Francis S. Husar
*Assistant Examiner*—Gene P. Crosby
*Attorney, Agent, or Firm*—Robert J. Black

[57] ABSTRACT

A tool and method for installing a flexible tube between two or more glass encapsulated reed switches of a multi-capsule reed relay switching assembly. The tool includes a rectangular horizontally oriented insertion member with a billhook raised at one end. The rectangular insertion member is arranged to narrow the tubing into a slightly egg-shaped configuration when the tubing is fitted over it. The billhook is adapted to partially penetrate an inside wall of the tubing allowing the tool to essentially drag the tubing into place. During installation the tubing collapses against the insertion member reducing the amount of initial interference between the tubing and the glass reed capsules.

6 Claims, 3 Drawing Figures

TOOL AND METHOD FOR INSTALLING FLEXIBLE TUBING IN A MULTI-CAPSULE REED RELAY SWITCHING ASSEMBLY

BACKGROUND OF THE INVENTION (1) Field of the Invention

This invention relates in general to an insertion tool and more particularly to a tool for inserting flexible tubing between a pair of glass encapsulated reed switches of a multi-capsule reed relay switching assembly.

(2) Description of the Prior Art

The present invention has its origin in the need for inserting a flexible tube between two or more glass encapsulated reed switches. The function of the tubing disclosed in application Ser. No. 906,547 filed May 17, 1978 by Jameel and Kopensteiner and having a common assignee with the present invention, is to dampen resonant vibration in the capsules, reducing critical bounce which results in circuit malfunction.

Due to physical limitations, such as the restricted space between the capsules, the resiliency of the tubing and the high coefficient of surface friction between the glass reed capsules and the tubing, it was determined that a special tool would be needed to insert the tubing into place.

Additionally, the tool should lend itself not only to installing the tubing in a switching assembly during manufacture, but also in the field, where a great number of switching assemblies are currently operating and mounted on circuit cards. Thus, the tool should be convenient for use not only during manufacture but also in the crowded field environment of a circuit card which may also include other electronic components.

Accordingly, it is the object of the present invention to provide a simple, effective tool for inserting flexible tubing between two or more glass encapsulated reed switches of a multi-capsule reed relay switching assembly.

SUMMARY OF THE INVENTION

In accomplishing the object of the present invention, there is provided as the environment, a multi-capsule reed relay switching assembly or correed of the type to which the invention is applied. The correed includes a hollow bobbin having a flange and a base portion on each end and at least two reed switches disposed longitudinally and in a spacial and parallel relation to each other within the bobbin.

The insertion tool, in accordance with the present invention, is formed from a rectangular piece of rigid material including a horizontally oriented insertion member with a sharp point or billhook on one end, raised in the intended direction in which the tubing is inserted into the correed. The rectangular shape of the tool, narrows the flexible tubing from a round to an egg-shaped cross section. This allows for a reduced amount of initial interference with the reed capsules when installing the tubing.

The tool is employed by fitting a substantial portion of a silicon glass fiber tube or other resilient tubing over the sharp point and insertion member. Manual pressure is applied on the outside of the tubing against the sharp point of the tool forcing it to partially penetrate the tubings inside wall. The tool is then inserted between the capsules in a forward direction with the point essentially dragging the tubing into place and allowing the tubing to collapse normally against the insertion member. The tool is disengaged from the tubing by simply withdrawing the tool in a reverse direction of the sharp point leaving the sleeving in place.

The tool is also equipped with a handle positioned upwardly and obliquely to the horizontal insertion member. The handle is oriented in this manner as to facilitate insertion of the tubing in correeds mounted on circuit cards.

DESCRIPTION OF THE DRAWINGS

A better understanding of the invention may be had from a consideration of the following detailed description taken in conjunction with the accompanying drawings in which.

DESCRIPTION OF THE PREFERRED EMBODIMENT

Figures 1, 2, 3:
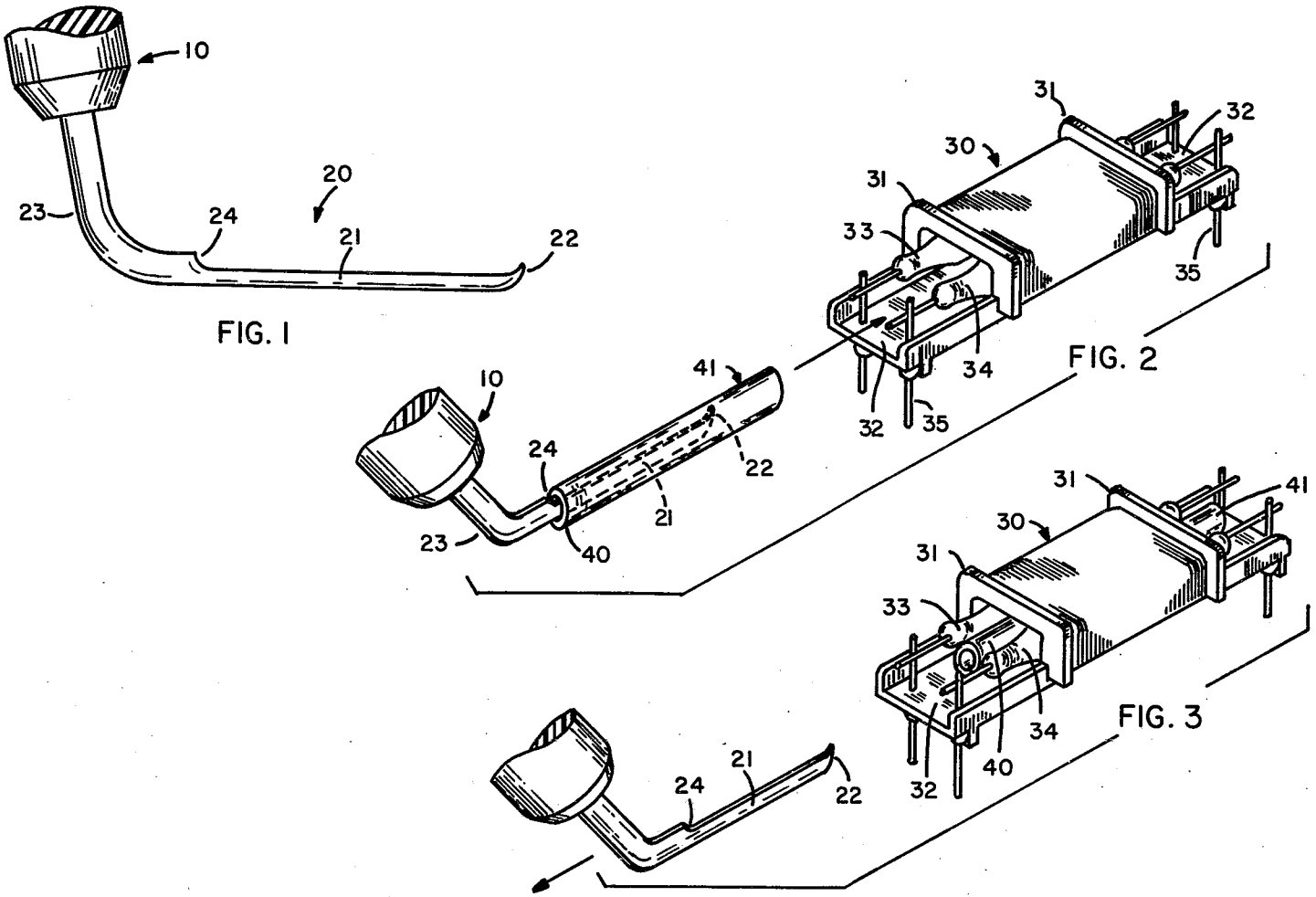
FIG. 1 is a side elevational view of the insertion tool in accordance with the present invention described herein.
FIG. 2 is a detailed perspective view of a multi-capsule reed relay switch assembly of the type to which the present invention is applied and a silicon glass fiber tube installed on the insertion tool prior to the insertion of the tubing into the multi-capsule reed relay switching assembly.
FIG. 3 is a detailed perspective view showing the installed tubing and the insertion tool withdrawn.

Referring now to the accompanying drawings, FIG. 1 illustrates the insertion tool according to the principles of the present invention. The tool is comprised of two elements, an insertion member 20 and a gripping handle 10. The insertion element is fabricated from a 0.032 inch by 0.125 inch rectangular piece of phosphor bronze and includes a horizontal central portion 21, a billhooked frontal portion 22 and an arcuately formed rear portion 23. Rear portion 23 has a height greater than central portion 21 which forms a stop shoulder 24 at one end. An opposite end of rear portion 23 further includes a gripping handle 10 mounted thereon.

Referring now to FIG. 2, a multi-capsule reed relay switching assembly or correed of the type to which the invention is applied is represented by hollow bobbin 30, having a flange 31 and a base portion 32 on each end. A pair of glass encapsulated magnetic latching reed switches 33, 34 are disposed longitudinally within the bobbin. Terminals 35 extend through each base portion and are connected to respective reed switch leads providing mechanical support and electrical connection. It should be noted that this description of the correed, illustrates the functional environment in this embodiment and forms no part of the invention.

The insertion tool is used to advantage by first fitting a round silicon glass fiber tube 40 over the billhooked frontal portion 22 and central portion 21, until the tubing contacts stop portion 24. The tube 40 is cut to an appropriate length corresponding to the physical length of each magnetic latching reed capsule. When tubing 40 is substantially fitted over insertion element 20 and against stop shoulder 24 a portion shown generally as 41 is left in its original and rounded form. Manual pressure is then applied to the outer wall of tubing 40 against the sharp tip of the billhook, forcing it to partially penetrate the inner wall of the tubing. The tool is then positioned for insertion by aligning the insertion element 20, carrying the now egg-shaped tubing, parallel and handle 10 perpendicular to reed capsules 33 and 34. Portion 41 is then inserted into bobbin 30 between the reed capsules in a forward direction. The combination of the billhook 22 and stop shoulder 24 essentially drag the tubing into place and the rectangular form of central portion 21 allows the tubing to collapse normally against the insertion member minimizing stress against the glass reed capsules. Upon complete insertion of the tubing, the tool is withdrawn backward out of correed 30 as shown on FIG. 3. As the tool is withdrawn billhook 22 is disengaged from the inner wall of tubing 40. Upon complete disengagement of the billhook and subsequent withdrawal of the tool tubing 40 springs back to its original rounded form. The tubing returns to its original form progressively as the tool is withdrawn, increasing the glass to tube contact area and allowing for a secure fitting. The high coefficient of friction between the tubing and the glass capsules keeps the tubing in place.

The present invention has been described with reference to a specific embodiment thereof, for the purpose illustrating the manner in which the invention may be used to advantage, and it will be appreciated by those skilled in the art that the invention is not limited thereto. Accordingly, any and all modifications, variations, or equivalent arrangements which may occur to those skilled in the art, should be considered to be within the scope of the invention.

We claim:

1. A tool for inserting a flexible tube including inner and outer walls between two or more parallel and spaced apart glass encapsulated reed switches of a reed relay switching assembly, said tool comprising:

a rigid, horizontal member including a rectangular central portion and a billhook shaped frontal portion;

said tool slidably inserted into said tubing, said central portion adapted to vertically elongate said tubing and said billhook upon application of manual pressure to said tubing outer wall partially penetrating said tubing inner wall allowing for insertion of said tubing between said reed switches.

2. A tool as recited in claim 1, wherein: said horizontal member includes a rectangular and arcuately formed rear portion including a front end and having a height greater than said central portion, said front end integrally joined to said central portion forming a stop shoulder thereat, said stop shoulder disposed to define the end most location which said tubing may be inserted over said central portion.

3. A tool as recited in claim 1, wherein: said rear portion further includes a rear end, said rear end fixedly mounted to a gripping handle.

4. A tool as recited in claim 2, wherein: said frontal portion, said central portion and said rear portion are composed as a one piece unitary structure of a rigid material.

5. The method of inserting a flexible tube between two or more parallel and spaced apart glass encapsulated reed switches of a reed relay switching assembly comprising the steps of:

fitting a flexible tube including inner and outer walls over an insertion tool, said tool including a rigid horizontal member having a rectangular central portion, and a billhook shaped frontal portion, said tubing vertically elongated when fitted over said billhook and said central portion;

applying pressure to said tubing outer wall causing said billhook to partially penetrate said tubing inner wall;

inserting said tool and said tubing between said reed switches in a first direction;

withdrawing said tool in a second and opposite direction allowing said tubing to form a friction fit between said tubing outer walls and said reed switches progressively as said tool is withdrawn allowing said tubing to return to its normal form.

6. The method recited in claim 5, wherein: said horizontal member further includes a rectangularly and arcuately formed rear portion, said rear portion having a height greater than said central portion and including a front end, said front end integrally joined to said central portion forming a stop shoulder thereat, said stop shoulder adapted to assist said billhook when said tool with said tubing is inserted between said reed switches.

* * * * *